United States Patent [19]

Viira

[11] Patent Number: 4,717,020

[45] Date of Patent: Jan. 5, 1988

[54] VERTICAL STORAGE TOOLBOX

[76] Inventor: Elmet Viira, 110 Duvernet Avenue, Toronto, Ontario M4E 1V4, Canada

[21] Appl. No.: 38,063

[22] Filed: Apr. 14, 1987

[51] Int. Cl.[4] ..... B65D 25/04; B65D 43/12; B25H 3/02

[52] U.S. Cl. ..... 206/372; 220/23; 220/331; 220/349; 312/DIG. 33

[58] Field of Search ..... 206/372–379; 220/23, 331, 345, 349, 351; 312/DIG. 33; 190/18 A

[56] References Cited

U.S. PATENT DOCUMENTS

| | | | |
|---|---|---|---|
| 1,238,074 | 8/1917 | Labadie et al. | 206/372 |
| 1,322,354 | 11/1919 | Scholtes | 206/373 |
| 1,597,092 | 8/1926 | McTighe | 206/373 |
| 2,735,541 | 2/1956 | Mosler | 220/23 |
| 2,983,367 | 5/1961 | Parmater et al. | 312/DIG. 33 |
| 3,159,441 | 12/1964 | Sikma | 220/331 |
| 3,446,386 | 5/1969 | Wellington | 220/23 |
| 4,240,684 | 12/1980 | Henning | 312/DIG. 33 |
| 4,266,835 | 5/1981 | Schmidt . | |
| 4,397,062 | 8/1983 | Huang | 190/18 A |

FOREIGN PATENT DOCUMENTS

| | | | |
|---|---|---|---|
| 860150 | 1/1941 | France | 312/DIG. 33 |

*Primary Examiner*—Stephen Marcus

*Attorney, Agent, or Firm*—Swabey, Mitchell, Houle, Marcoux & Sher

[57] ABSTRACT

A toolbox receptacle with a sloped face typically inclined at 5°–85° to the horizontal, with a preferred slope of 15°–65°, contains a series of compartments inside, specifically designed for holding tools and materials of various sizes; the series of compartments may be removable; the compartments recede in a sloped fashion, but not necessarily with the same slope as the terminating margins of the receptacle; this design facilitates use by a user since all the tools in the sloped compartments can be seen at once and may be stored more easily; the toolbox may contain a top wedge shaped nesting section which slides along a flanged sloped face of the lower section of the toolbox assisted by longitudinal slots in the flanges of the bottom section of the toolbox and corresponding slots in the top wedge shaped section; the receptacle in its preferred form is made from metal or plastic, and may include folding wheels and support framework.

5 Claims, 5 Drawing Figures

VERTICAL STORAGE TOOLBOX

BACKGROUND OF THE INVENTION (i) Field of the Invention

This invention relates to a receptacle for holding tools or other items of a solid dry, nature (i.e., not liquids).

(ii) Description of the Prior Art

It is common for toolboxes of previous design to have the bulk of the tools thrown on the bottom and smaller tools stored in folding trays at the top. Toolboxes are also known which comprise a series of drawers.

In both of those prior designs there can be a considerable loss of time in searching for tools if the user does not know where the tool is or where it has been put, since all the tools are not visible at the same time. Also when the toolboxes become quite full there can be loss of time in removing tools on top to get at tools on the bottom.

It is an object of the present invention to provide toolboxes overcoming the disadvantages of these prior tool boxes.

SUMMARY OF THE INVENTION

In accordance with this invention it has been found that the disadvantages associated with prior toolboxes may be overcome by a toolbox having a high back wall and a low front wall with sloped side walls. A series of compartments is defined between the wall which rise in a gradual fashion from the front wall to the back wall allowing the user to put large tools at the back and small tools at the front. The compartments are easily accessible and when the tools are stored properly, with the tool or item sticking an inch or so above the compartment top edge they are quickly accessible, and all the tools are easily visible to make inventory simple.

To further accommodate efficient space utilization the toolbox has a bottom section which supports, riding on top of it, a receptacle resembling a wedge. Also as an option, for toolboxes carrying heavier materials, wheels, especially folding or retractable wheels, and associated framework aid in transportation and field use.

Thus, in particular the invention provides a receptacle which has a bottom section and a top wedge-shaped section; the bottom section has a floor and, extending upwardly of the floor, spaced apart front and back walls in opposed facing relationship and side walls extending between the front and back walls. The front wall is of a lesser height than the back wall and the side walls are of generally quadrilateral shape. The quadrilateral side walls have an upper angle defined between the upper edges and rear edges of the side walls which is smaller or less than the other three angles of the quadrilateral defined by such side walls. A plurality of compartments is defined in the bottom section, at least some of which extend in a vertical manner; in particular these compartments may be defined by vertically extending inner walls extending between the opposed side walls, the opposed front and back walls or both. The top wedge-shaped section slides on the bottom section via longitudinal guide means.

The longitudinal guide means may particularly comsprise a pair of parallel longitudinal slots in the bottom section, one slot being formed in each side wall on flanges extending from a top face of the side wall section, and corresponding slots in a floor of the top wedge-shaped section, first guide or slide members mounted on opposite sides of the floor of the top section and slidingly received in the slots of the bottom section, and second guide or slide members on the flanges and slidingly received in the slots of the top section.

The use of first and second guide members on each side of the toolbox aids in uniform travel and prevents the top wedge-shaped section from flopping around when the toolbox is in the closed position.

BRIEF DESCRIPTION OF THE DRAWINGS

The invention is further illustrated in particular and preferred embodiments by reference to the accompanying drawings in which.

DESCRIPTION OF PREFERRED EMBODIMENTS WITH REFERENCE TO THE DRAWINGS

Figure 1:
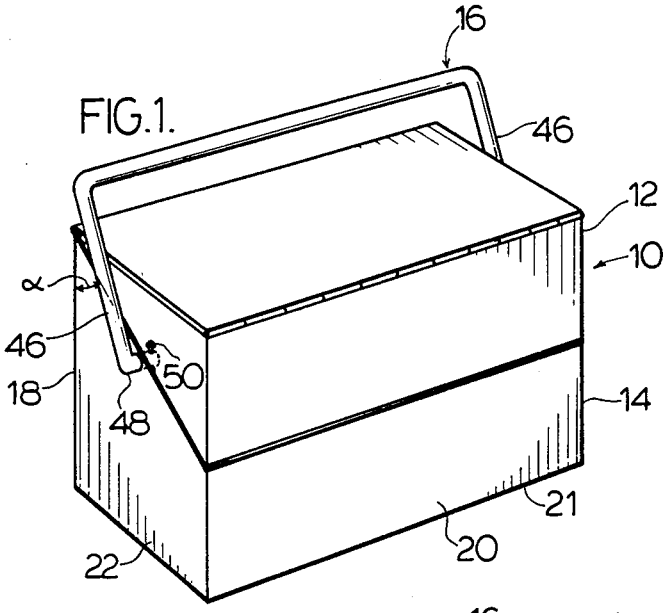
FIG. 1 is a perspective view of a tool box of the invention, in the closed configuration.

With further reference to FIG. 1, a tool box 10 has a wedge-shaped top section 12, a bottom section 14 and a handle 16.

Bottom section 14 has a rear wall 18, a front wall 20 and quadrilateral side walls 22 extending vertically upwardly from a floor 21.

Wedge-shaped top section 12 has a floor 13.

The uppermost angle $\alpha$ of the quadrilateral side walls 22 is the smallest angle of the quadrilateral side walls 22.

Figure 2:
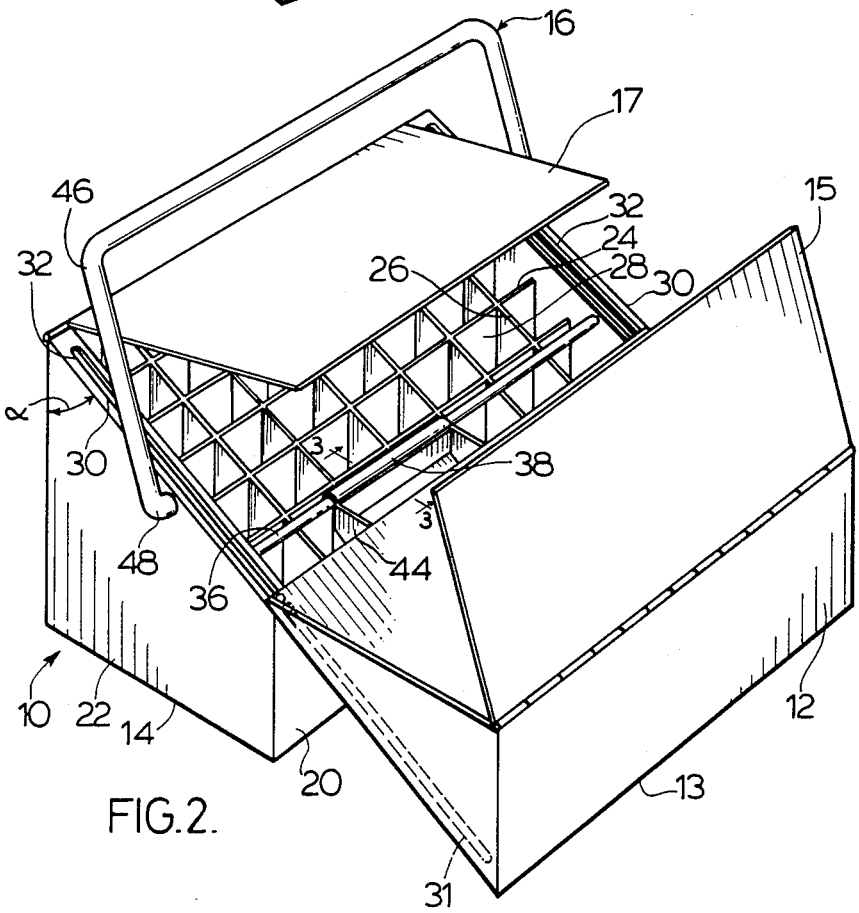
FIG. 2 is a perspective view of the box of FIG. 1 in the open configuration.

With further reference to FIG. 2, partition members 24 extend between the side walls 22 and partition members 26 extend between the rear and front walls 18 and 20, respectively, and define internal compartments 28.

Top flanges 30 extend inwardly of side walls 22 and generally perpendicular thereto, and elongate slots 32 are formed in top flanges 30.

Figure 3:
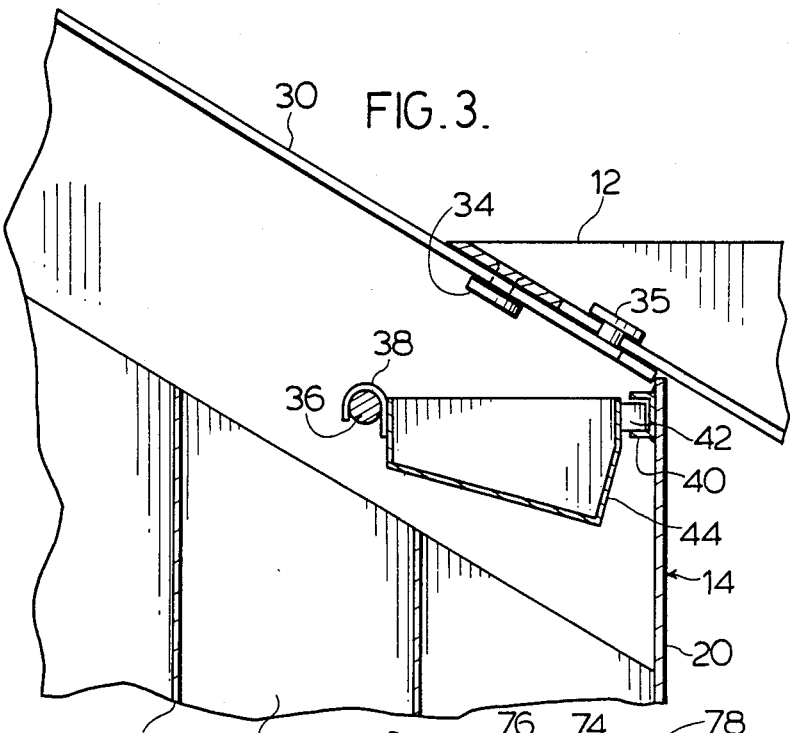
FIG. 3 is a cross-section on line 3—3 of FIG. 2.

With particular reference to FIG. 3, top section 12 includes a pair of spaced apart first guide members 34 extending downwardly from floor 13 which are slidingly received in slots 32, and bottom section 14 includes a pair of spaced apart second guide members 35 which are slidingly received in slots 31, whereby top section 12 may slide relative to bottom section 14 to permit entry to bottom section 14 as illustrated in FIG. 2.

As particularly shown in FIG. 2, top section 12 has a hingedly mounted lid 15 and bottom section 14 has a hingedly mounted lid 17, which rests on internal compartments 28.

Lid 17 may have a plurality of clips or band members (not shown) on its interior face for mounting small tools or objects.

With particular reference to FIG. 3, a bar 36 extends between side walls 22 close to front wall 20 and an outer elongate channel member 40 extends, generally parallel thereto, along the interior face of front wall 20.

A sliding tray 44 is slidably mounted on bar 36 by C-shaped clip 38 and is slidingly mounted in outer channel member 40 by a slidable channel member 42.

Handle 16 includes a pair of side legs 46 which terminate in feet 48 extending through side walls 22 and secured by cotter pins 50.

Figure 5:
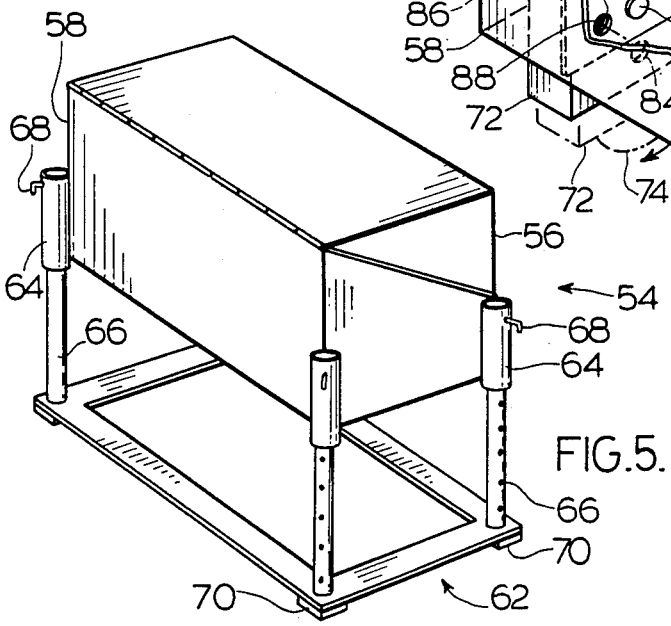
FIG. 5 is a perspective view of a tool box of the invention in yet another embodiment.

With reference to FIG. 5, there is shown a toolbox 54 having a top wedge-shaped section 56 and a bottom section 58. These components of the tool box 54 may be generally the same as those of toolbox 10. Toolbox 54 may additionally include a handle (not shown) similar to handle 16 of FIG. 1.

Toolbox 50 additionally includes a telescopic or retractable base 62 which comprises four small diameter pipes 66 terminating in feet 70. Pipes 66 are telescopically received within support tubes 64 mounted at the corners of toolbox 54. When base 62 is telescoped out of support tube 64 it may be locked in position by knock out pins 68.

In order to facilitate transport of toolbox 54 it may include folding wheels.

Figure 4:
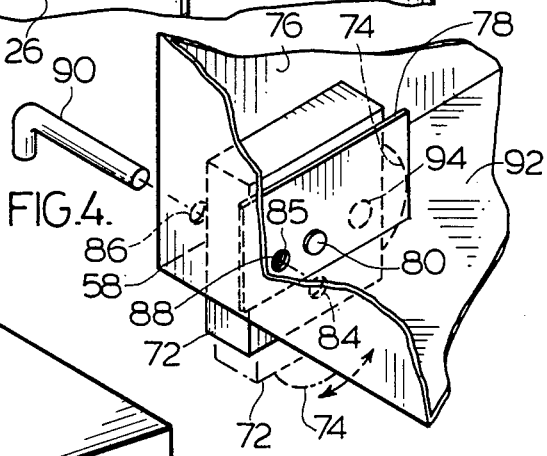
FIG. 4 shows a detail of a tool box of the invention in a different embodiment.

With further reference to FIG. 4, a wheel 74 is mounted in a wheel compartment 72 at each lower corner of bottom section 58. Each wheel 74 is rotatably mounted in its wheel compartment 72 on spindle 94. Wheel compartment 72 is pivotally movable between raised and lowered positions shown in broken line in FIG. 4 and can be locked in these respective positions.

In particular, compartment 72 is pivotally mounted about a pivot rod 80 whereby it may be pivoted from a lowered position in which the wheels 74 may roll along a surface, to a raised position generally perpendicular to the lower position, which raised position is considered the folded configuration.

Each compartment 72 is pivotally mounted on its pivot rod 80 between a rear wall 76 of bottom section 58 and an inner partition wall 78 which suitably is cut out of floor 92 of bottom section 58, and bent back to a raised position perpendicular to floor 92.

Compartment 72 has through locking holes 84 and 85 and rear wall 76 and partition wall 78 having aligned locking holes 86 and 88 respectively.

In the lowered configuration, locking hole 84 is place by means of locking pin 90 passing through the aligned holes. In the raised configuration locking hole 85 is aligned with holes 86 and 88 and compartment 72 can be locked in place by means of locking pin 90 passing through the aligned holes.

It will be understood that the wheel structure of FIG. 4 may be or absent from the toolboxes 10 and 54 of FIGS. 1 and 5, respectively.

The handle 16 may suitably be formed of a round bar or may comprise a wooden handle supported by flat bar or channel iron.

The toolbox is suitably fabricated from sheet metal with lids 15 and 17 secured by hinges which may be secured by, for example, welding or bolting to sections 12 and 14.

Suitably the top sections 12 and 56 may be locked to the bottom sections 14 and 58, respectively, for transportation, by means of a hasp or key lock (not shown).

It will be recognized that the top sections 12 and 56 slide relative to their bottom sections 14 and 58 to permit access to the interior.

The compartments 28 are of increasing depth from front to rear of the toolboxes 10 and 54 whereby the tools disposed therein are more readily located.

The partition members 24 and 26 may be secured by, for example, welding or bolting, and may, for example, be slotted for inter-engagement with each other.

The partition members 24 and 26 may form an integral unit removable from the toolbox 10 or secured within the toolbox 10 and may be of varying sizes.

The toolbox may be fabricated from materials other than metal, for example, plastic.

The first and second guide members may comprise metal studs or buttons or bolts with nuts threaded thereon to secure them in place.

It will be understood that FIGS. 1 to 5 herein serve as an illustration of possible embodiments of the invention only, and certain novel features of the invention have been shown and described with reference to the drawings and are pointed out in the annexed claims; it will be understood that there may be additions and/or retractions and/or changes made in the skilled in the art without departing drawings by persons skilled in the art without departing from the spirit of the invention.

I claim:

1. A receptacle comprising:

a bottom section and a top wedge-shaped section, said bottom section having a floor, back wall, front wall of lesser height than said back wall, a pair of sidewalls of generally quadrilateral shape, each sidewall of said pair having a top face, with the top angle of the quadrilateral sidewalls being smaller than any of the other three angles, a plurality of compartments in said bottom section, at least some of which extend in a vertical fashion, said top wedge-shaped section having a floor and being adapted to slide along the bottom section via slide means provided in said bottom section, said top wedge-shaped section being provided with at least one compartment, said slide means comprising a pair of elongated slots in parallel, spaced apart relationship, each slot being formed in a said top face of a said sidewall of said pair, and slide members mounted on said floor of said top section and slidingly received in said slots, and said slide means further including a second pair of elongated slots in parallel spaced apart relationship, each slot of said second pair being formed in said floor of said top section, and second slide members mounted on the top faces of said sidewalls and slidingly received in said second pair of slots.

2. A receptacle as in claim 1, wherein folding wheels are provided on said bottom section to facilitate transportation of said receptacle.

3. The receptacle of claim 1, including a handle to assist in lifting said receptacle.

4. The receptacle of claim 1, including trays disposed within said walls to accommodate contents of the receptacle.

5. A receptacle according to claim 1, wherein said top faces of said sidewalls are defined by flanges.

* * * * *